US008130059B2

(12) United States Patent
Wang et al.

(10) Patent No.: US 8,130,059 B2
(45) Date of Patent: Mar. 6, 2012

(54) ON CHIP SLOW-WAVE STRUCTURE, METHOD OF MANUFACTURE AND DESIGN STRUCTURE

(75) Inventors: Guoan Wang, South Burlington, VT (US); Wayne H. Woods, Jr., Burlington, VT (US)

(73) Assignee: International Business Machines Corporation, Armonk, NY (US)

( * ) Notice: Subject to any disclaimer, the term of this patent is extended or adjusted under 35 U.S.C. 154(b) by 188 days.

(21) Appl. No.: 12/423,835

(22) Filed: Apr. 15, 2009

(65) Prior Publication Data

US 2010/0265007 A1 Oct. 21, 2010

(51) Int. Cl.
*H01P 1/18* (2006.01)

(52) U.S. Cl. ..... 333/156; 333/161

(58) Field of Classification Search ..... 333/156, 333/161, 204, 238, 246
See application file for complete search history.

(56) References Cited

U.S. PATENT DOCUMENTS

| | | | | |
|---|---|---|---|---|
| 4,340,873 | A | 7/1982 | Bastida | |
| 4,914,407 | A | 4/1990 | Itoh | |
| 5,479,138 | A * | 12/1995 | Kuroda et al. | 333/1 |
| 5,633,479 | A * | 5/1997 | Hirano | 174/255 |
| 5,777,532 | A | 7/1998 | Lakin | |
| 5,982,249 | A * | 11/1999 | Bruns | 333/1 |
| 6,023,209 | A * | 2/2000 | Faulkner et al. | 333/238 |
| 6,307,252 | B1 * | 10/2001 | Knoedl, Jr. | 257/659 |
| 6,512,423 | B2 * | 1/2003 | Koga | 333/1 |
| 6,950,590 | B2 | 9/2005 | Cheung et al. | |
| 7,091,802 | B2 | 8/2006 | Ham et al. | |
| 7,242,272 | B2 * | 7/2007 | Ham et al. | 333/238 |
| 7,332,983 | B2 * | 2/2008 | Larson | 333/161 |
| 7,812,694 | B2 * | 10/2010 | Ding et al. | 333/238 |
| 2004/0066251 | A1 | 4/2004 | Eleftheriades et al. | |
| 2005/0146402 | A1 | 7/2005 | Sarabandi et al. | |
| 2007/0096848 | A1 | 5/2007 | Larson | |
| 2008/0059924 | A1 * | 3/2008 | Hsu et al. | 716/4 |
| 2009/0021323 | A1 * | 1/2009 | Lee | 333/12 |
| 2010/0225425 | A1 * | 9/2010 | Cho | 333/238 |

OTHER PUBLICATIONS

Cho et al., "A Millimeter-wave Micromachined Slow-Wave Bandpass Filter Using Compact Microstrip Stepped-Impedance Hairpin Resonator", Oct . 2005.

Zelun et al., "A New Type of Multi-Beam Slow-Wave Structure of Millimeter Wave Traveling Wave Tube", IEEE 2007 International Symposium on Microwave, Antenna, Propagation, and EMC Technologies for Wireless Communications, pp. 323-326.

Chirala et al., "Multilayer Design Techniques for Extremely Miniaturized CMOS Microwave and Millimeter-Wave Distributed Passive Circuits", IEEE Transactions on Microwave Theory and Techniques, vol. 54, No. 12, Dec. 2006, pp. 4218-4224.

(Continued)

*Primary Examiner* — Seungsook Ham

(74) *Attorney, Agent, or Firm* — Anthony Canale; Roberts Mlotkowski Safran & Cole, P.C.

(57) ABSTRACT

An on-chip slow-wave structure that uses multiple parallel signal paths with grounded capacitance structures, method of manufacturing and design structure thereof is provided. The slow wave structure includes a plurality of conductor signal paths arranged in a substantial parallel arrangement. The structure further includes a first grounded capacitance line or lines positioned below the plurality of conductor signal paths and arranged substantially orthogonal to the plurality of conductor signal paths. A second grounded capacitance line or lines is positioned above the plurality of conductor signal paths and arranged substantially orthogonal to the plurality of conductor signal paths. A grounded plane grounds the first and second grounded capacitance line or lines.

25 Claims, 8 Drawing Sheets

OTHER PUBLICATIONS

Sayag et al., "A 25 GHz 3.3 db NF Low Noise Amplifier based upon Slow Wave Transmission Lines and the 0.18 μm CMOS Technology", 2008 IEEE Radio Frequency Integrated Circuits Symposium, pp. 373-376.

International Search Report and Written Opinion, Application Serial # PCT/US2010/027771, Date Mailed: Oct. 26, 2010, Title: "On Chip Slow-Wave Structure, Method of Manufacture and Design Structure" Filing Date: Mar. 18, 2010.

* cited by examiner

ON CHIP SLOW-WAVE STRUCTURE, METHOD OF MANUFACTURE AND DESIGN STRUCTURE

FIELD OF THE INVENTION

The present invention relates to a multiple conductor slow-wave configuration circuit path, and more particularly, to an on-chip slow-wave structure that uses multiple parallel signal paths with grounded capacitance structures, method of manufacturing the same and design structure thereof.

BACKGROUND

There has recently been a renewed interest in the implementation of passive circuits that target communication and radar applications in the millimeter wave range. For example, is has been recognized that passive components limit the speed and frequency range of circuits at RF and higher operating frequencies. As such, at frequencies where wavelengths are shorter than 10, mm (i.e., millimeter wave or above 12, GHz for signals on a silicon chip) the signal delay over interconnections can be factored into a typical integrated circuit design. However, as frequency drops toward the lower end of the millimeter wave band and into the microwave band, passive circuit design increasingly poses challenges with respect to size. One way to overcome such issues is to incorporate slow wave structures into the device.

Slow wave structures are used in signal delay paths for phased array radar systems, analog matching elements, wireless communication systems, and millimeter waver passive devices. Basically, such structures can exhibit high capacitance and inductance, with a low resistance, per unit length. This can be advantageous to applications requiring high quality narrow band microwave band pass filters and other on chip passive elements.

In conventional slow wave structures, a single top conductor is disposed on an insulator (typically silicon dioxide) and attached to a metal ground plane. More specifically, in a conventional slow wave structure, a single path on a thick metal layer is used in a slow wave configuration where grounded or floating orthogonal metal crossing lines provide increased capacitance without affecting the inductance significantly. At the top level, due to scaling issues, the conductor signal path becomes very large, e.g., 18, microns wide and upwards of 4, microns thick. Also, in conventional applications, the conductor signal path can be vertically separated by upwards of 12, microns above the ground plane. While this transmission line is simple, it does not maximize capacitance per unit length, nor does it decrease in size.

Accordingly, there exists a need in the art to overcome the deficiencies and limitations described hereinabove.

SUMMARY

In an aspect of the invention, a slow wave structure comprises a plurality of conductor signal paths arranged in a substantial parallel arrangement. The structure further comprises a first grounded capacitance line or lines positioned below the plurality of conductor signal paths and arranged substantially orthogonal to the plurality of conductor signal paths. A second grounded capacitance line or lines is positioned above the plurality of conductor signal paths and arranged substantially orthogonal to the plurality of conductor signal paths. A grounded plane grounds the first and second grounded capacitance line or lines.

In another aspect of the invention, a slow wave structure, comprises a ground plate and a first grounded capacitance line having segments arranged in a substantial parallel arrangement. The first ground capacitance line is grounded to the ground plate. A second grounded capacitance line has segments arranged in a substantial parallel arrangement and is grounded to the ground plate. A plurality of conductor signal paths are arranged between the first grounded capacitance line and the second grounded capacitance line. The plurality of conductor signal paths are arranged in a parallel arrangement and orthogonal to the first grounded capacitance line and the second grounded capacitance. A plurality of capacitance shields are arranged between each of the plurality of conductor signal paths and connected to the first grounded capacitance line and the second grounded capacitance line at corresponding positions.

In another aspect of the invention, a method of manufacturing a slow wave structure, comprises: forming a lower grounded capacitance line in an insulator material, above a grounded plane; forming a plurality of conductor signal paths in a substantial parallel arrangement in the insulator material and above the lower grounded capacitance line, the plurality of conductor signal paths being formed substantially orthogonal to the upper grounded capacitance line; and forming an upper grounded capacitance line in the insulator material above the plurality of conductor signal paths, the upper grounded capacitance line being formed substantially orthogonal to the plurality of conductor signal paths.

In another aspect of the invention, a design structure embodied in a machine readable medium for designing, manufacturing, or testing an integrated circuit is provided. The design structure comprises the structures and/or methods of the present invention.

BRIEF DESCRIPTION OF THE SEVERAL VIEWS OF THE DRAWINGS

The present invention is described in the detailed description which follows, in reference to the noted plurality of drawings by way of non-limiting examples of exemplary embodiments of the present invention.

DETAILED DESCRIPTION

The present invention relates to a multiple conductor slow-wave configuration circuit path, and more particularly, to an on-chip slow-wave structure that uses multiple parallel (or substantially parallel) signal paths with grounded capacitance structures, a method of manufacturing the on-chip structure and design structure thereof. More specifically, the present invention comprises an on-chip structure having multiple conductor slow-wave configuration circuit paths comprising a plurality of parallel (or substantially parallel) spaced conductors, compared to one thick conductor of conventional systems. Advantageously, the on-chip slow-wave structure with multiple parallel signal paths significantly increases the capacitance per unit length and delay of the slow-wave structure, while maintaining acceptable resistance per unit length.

In embodiments, the structure of the present invention includes multiple small metal signal lines with orthogonal top and bottom cap shields coupled to side cap stub shields. The structure of the invention will thus provide maximize capacitance without decreasing inductance. The multiple small metal signal lines can advantageously be located on lower BEOL levels (e.g., M2, M3, M4, where the set of metals levels M1, M2, etc. are arranged starting from closest to the silicon level and upwards respectively), which has the advantage of being able to use smaller lines (e.g., width, thickness and spacing). The structure of the present invention is well suited for microwave and millimeter wave (MMW) passive element designs such as amplifier matching elements or delay lines in RFCMOS/BiCMOS technologies, amongst other applications.

Figure 1A:
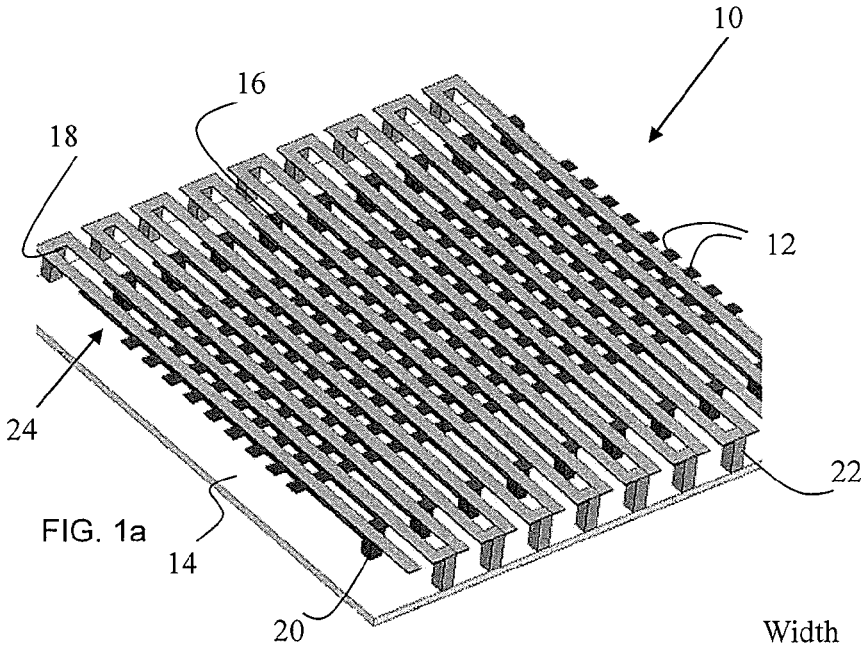
FIG. 1*a*, shows a single layer multi-conductor signal path in accordance with aspects of the invention.

FIG. 1*a*, shows a single layer multi-conductor signal path in accordance with aspects of the invention. In particular, the single layer multi-conductor signal path structure is generally shown as reference numeral 10 and includes a single layer of a plurality of conductor signal paths 12 at a lower level, e.g., M1 level; although, those of skill in the art should appreciate that the present invention can include multiple layers of the plurality of conductor signal paths (associated with different metal levels as discussed with reference to FIG. 5). In embodiments, the plurality of conductor signal paths 12 are arranged in parallel (or substantially parallel) above a ground plane 14; although the ground plane can be above the conductor signal paths 12 on a topmost level. The ground plane 14 can be approximately 50, microns wide and of varying thickness such as, for example, approximately 0.2, microns to approximately 4.0, microns in thickness.

Still referring to FIG. 1*a*, in embodiments of the invention, the structure 10 is shown with nine conductor signal paths 12; although, the present invention contemplates more or less conductor signal paths 12 depending on the desired capacitance and/or resistance for a particular technology and/or the level of structure. The larger the number of conductor signal paths 12 results in an increased capacitance and a decreased resistance, compared to a conventional, single signal path. Also, the number of signal lines will not significantly affect inductance. In embodiments of the invention, the conductor signal paths 12 can be any metal conductor such as, for example, copper or aluminum.

As should be understood by those of skill in the art, capacitance is inversely proportional to the distance between conductor signal paths. As such, it is advantageous to have the conductor signal paths 12 packed as densely as possible in order to increase the capacitance of the structure, and hence increase its delay, i.e., slow the structure. For example, at the lower or bottom levels of the structure formed during back end of the line processes (BEOL), it is possible to arrange the conductor signal paths 12 at a distance of about 0.2, microns from each other, thus significantly increasing the density of the structure and hence capacitance. Beneficially, the resistance of the structure does not increase, i.e., remains low, thus contributing to the increased performance of the on chip structure.

At higher metal levels, it is contemplated that the spacing can range from about 0.4, microns upwards to about 2.5, microns. In still other embodiments, the spacing can be about 4, microns apart, on higher levels such as, for example, the M7 level of current technologies. (This is compared to a conventional structure which has a single conductor path at only the highest level, which results in lower capacitance per unit length). It should be understood, though, that the spacing or distances described herein are exemplary distances and that other distances are also contemplated with the present invention. Also, and advantageously, the distance between the conductor signal paths 12 can be scaled for newer technologies.

As further shown in FIG. 1*a*, the conductor signal paths 12 are positioned between lower grounded capacitance line(s) (shields) 16 and upper grounded capacitance line(s) (shields) 18. The lower grounded capacitance lines 16 and the upper grounded capacitance lines 18 are electrically grounded to the ground plane 14 by via structures 20 and 22, respectively. The via structures 20, 22, much like the lower grounded capacitance lines 16 and the upper grounded capacitance lines 18, can be any metal such as, for example, aluminum or copper. In one embodiment, each of the lower grounded capacitance lines 16 and the upper grounded capacitance lines 18 are a single line arranged in a serpentine shape, although, this should not be considered a limiting feature of the present invention. For example, the lower grounded capacitance lines 16 and the upper grounded capacitance lines 18 can be multiple parallel crossing signal lines.

To increase capacitance of the structure, the conductor signal paths 12 are positioned orthogonal to the lower grounded capacitance lines 16 and the upper grounded capacitance lines 18. This arrangement will increase the capacitance ("C") of the slow-wave structure, without affecting inductance ("L"). In further embodiments, the density of conductor signal paths 12, the lower grounded capacitance lines 16 and the upper grounded capacitance lines 18 should be maximized in order to maximize the increase in capacitance ("C") of the slow-wave structure 10. Also, as should be understood by those of skill in the art, the structures 12, 16, 18, 20 and 22 can be formed (embedded) within an insulator layer 24 such as, for example, oxide or low K dielectric. The insulator layer 24 will ensure, for example, that the lower grounded capacitance lines 16 and the upper grounded capacitance lines 18 do not short to the conductor signal paths 12, as well as provide structural support.

Figure 1B:
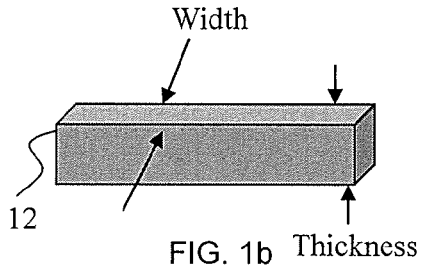
FIG. 1*b*, shows a single signal conductor in accordance with aspects of the invention.

FIG. 1*b*, shows a single conductor signal path 12 in accordance with aspects of the invention. In embodiments, the conductor signal path 12 can range in width from about 0.05, micron to 10, microns and more preferably about 0.1, micron to about 4, microns, depending on the particular application and metal level. Typically, for example, the conductor signal paths 12 on lower metal levels can have a thickness of about 0.05, microns, to about 0.4, microns and in, one embodiment, about 0.32, microns. The conductor signal paths 12 on the upper metal layers will have a thicker (wider) profile, in the range from about 4, microns to about 10, microns, depending on the metal layer. The signal conductor 12 can also have a spacing therebetween of about 0.05, microns; although, other dimensions are contemplated by the invention.

Figure 2:
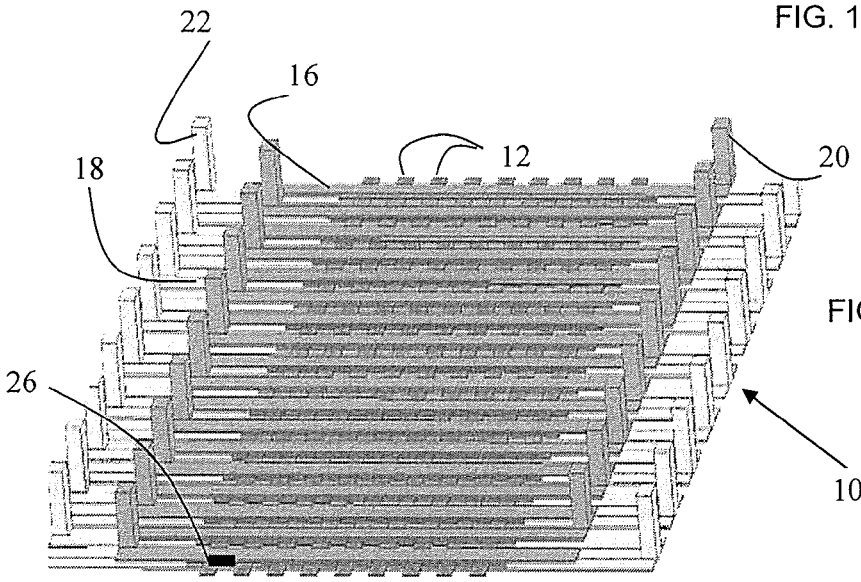
FIG. 2 shows an underside of the single layer multi-conductor signal path in accordance with aspects of the invention.

FIG. 2 shows an underside of the single layer multi-conductor signal path in accordance with aspects of the invention. In particular, FIG. 2 shows the single layer multi-conductor signal path structure 10 of FIG. 1 without the ground plane 14. In this view, it is seen that the conductor signal paths 12 are positioned between the lower grounded capacitance lines 16 and the upper grounded capacitance lines 18. The conductor signal paths 12 are shown in a single layer, and are vertically separated from the lower grounded capacitance lines 16 and the upper grounded capacitance lines 18. Capacitance shields or stubs 26 are connected by vias to the lower grounded capacitance lines 16 and the upper grounded capacitance lines 18. As should be understood, the capacitance shields or stubs 26 are, in embodiments, positioned between each of the conductor signal paths 12, connected to each of the lower grounded capacitance lines 16 and the upper grounded capacitance lines 18. The capacitance shields or stubs 26 are formed within the insulator layer 24 and are designed to increase the lateral capacitance of the conductor signal paths 12 to ground.

Figure 3:
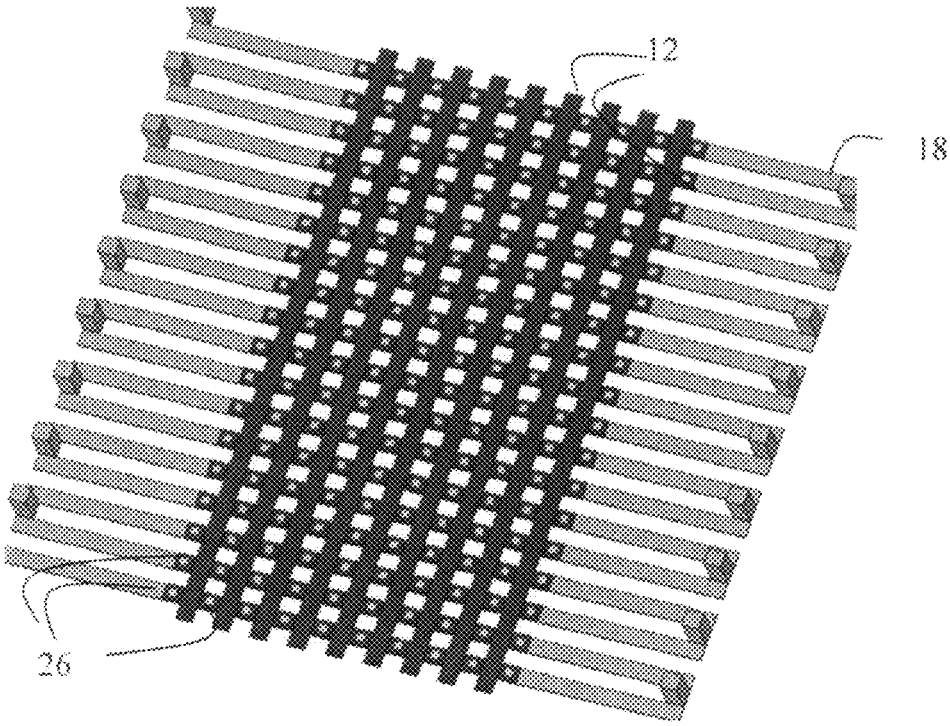
FIG. 3 shows a partial structure of the single layer multi-conductor signal path in accordance with aspects of the invention.

FIG. 3 shows a partial structure of the single layer multi-conductor signal path in accordance with aspects of the invention. This view shows the structure of FIG. 2 without the lower grounded capacitance lines 16. As clearly seen in FIG. 3, the capacitance shields or stubs 26 are, in embodiments, positioned between each of the conductor signal paths 12, connected to each of the upper grounded capacitance lines 18 and the lower grounded capacitance lines 16 (not shown). The capacitance shields or stubs 26 can have a thickness of about 0.32, microns; although other dimensions are contemplated by the present invention. For example, it is contemplated that the thickness of the capacitance shields or stubs 26 can range from about 0.1, microns to about 4, microns. Also, the width of the capacitance shields or stubs 26 can vary and, in embodiments, can range from about 0.2 microns to about 10, microns, depending on the metal level layer. The combination of the multiple conductor signal paths 12, orthogonal lines 16, 18 and the capacitance shields or stubs 26 significantly increases the capacitance of the slow-wave structures per unit length, thereby resulting in a much slower than conventional slow-wave structure.

Figure 4:
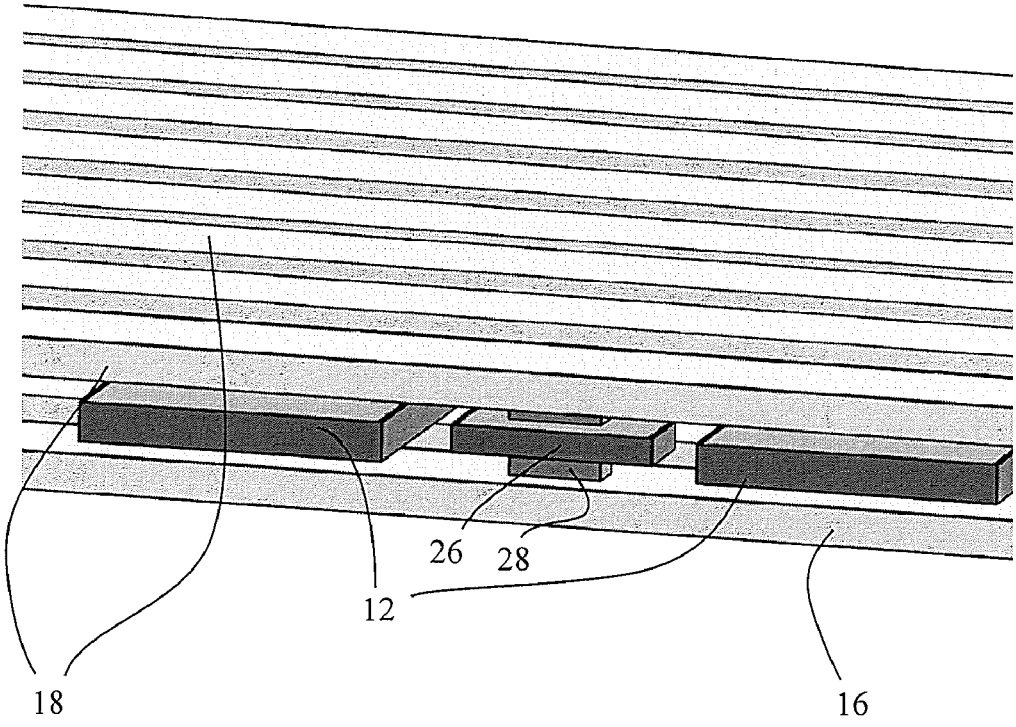
FIG. 4 shows an enlarged view of the single layer multi-conductor signal path of FIG. 2 in accordance with aspects of the invention.

FIG. 4 shows an enlarged view of the single layer multi-conductor signal path of FIG. 2 in accordance with aspects of the invention. More specifically, FIG. 4 shows the conductor signal paths 12 between the capacitance shields or stubs 26. Also, the capacitance shields or stubs 26 are arranged between the lower grounded capacitance lines 16 and the upper grounded capacitance lines 18 and separated therebetween by via structures 28. The via structures 28 can be, for example, any metal material suitable for use with the structure of the present invention, embedded or formed within the insulator layer. Also, the conductor signal paths 12 are shown to be arranged between the lower grounded capacitance lines 16 and the upper grounded capacitance lines 18.

In embodiments, the capacitance shields or stubs 26 are positioned as close as possible to the conductor signal paths 12, with the conductor signal paths 12 as densely packed as practical. In this way, the structure of the present invention can increase its capacitance in order to slow the signal propagation through the structure. For example, the spacing between the capacitance shields or stubs 26 and the conductor signal paths 12 can be about 0.05, microns. In higher metal level layers, the spacing can range from about 0.2 microns to about 4, microns, for example. Also, in embodiments, the spacing between the conductor signal paths 12 and the lower grounded capacitance lines 16 and the upper grounded capacitance lines 18 is about 0.05, microns. Those of skill in the art should understand, though, that the spacing can vary depending on such factors as, for example, the dimensions of the conductor signal paths 12, the metal layer in which the conductor signal paths 12 reside, the dimensions of the capacitance shields or stubs 26, etc.

Figure 5:
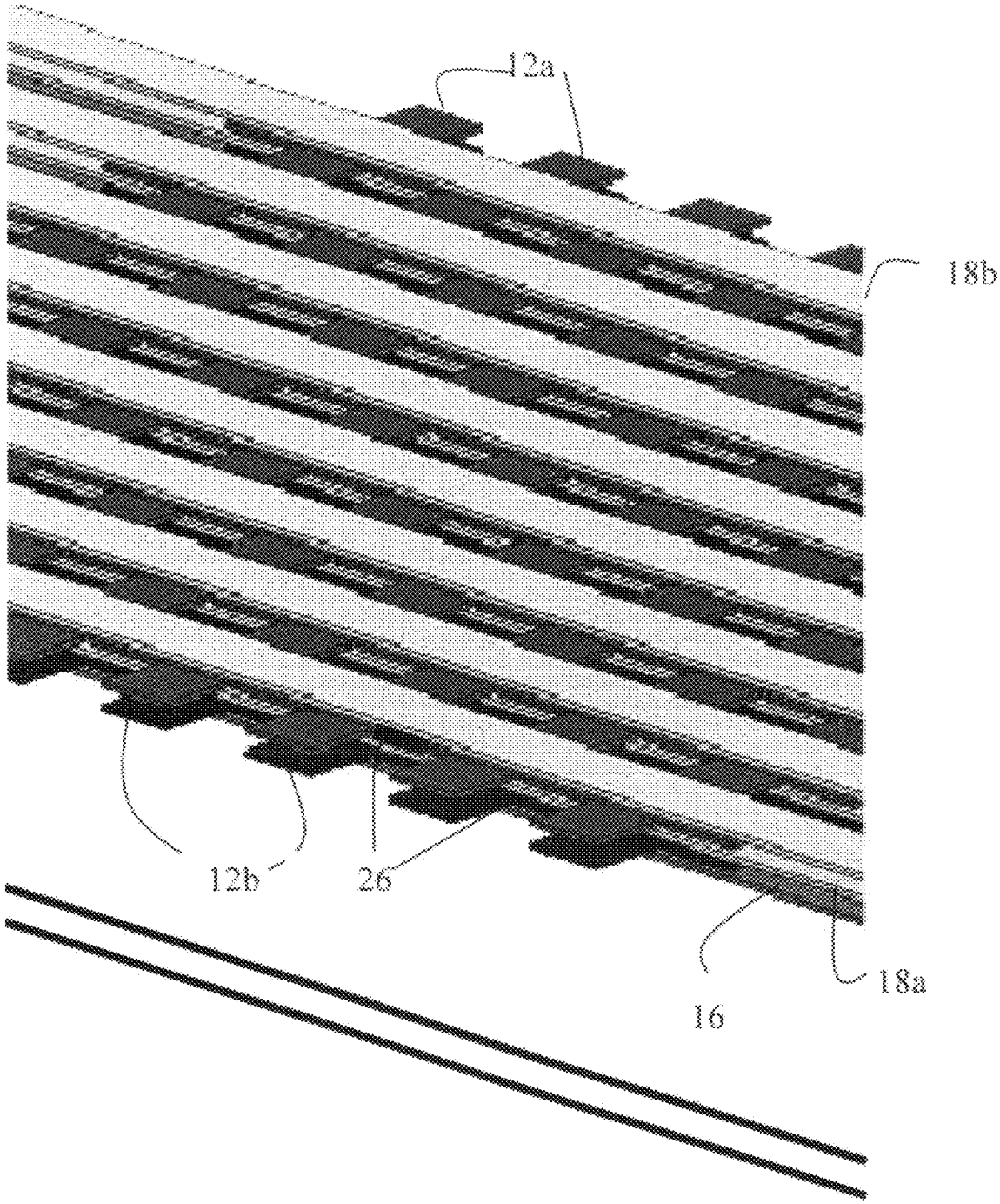
FIG. 5 shows a multi-layer multi-conductor signal path in accordance with aspects of the invention.

FIG. 5 shows a multi-layer multi-conductor signal path in accordance with aspects of the invention and a conventional structure. More specifically, FIG. 5 shows two levels of conductor signal paths 12*a*, and 12*b*. In embodiments, though, additional layers of conductor signal paths are contemplated by the present invention. For example, eight or more conductor BEOL levels can be arranged on the chip, depending on the state of technology. In embodiments, the conductor signal paths 12*a*, and 12*b*, are parallel and aligned, but they can also be offset with respect to one another. As discussed above, the dimensions of each conductor signal path can vary from level to level, with larger dimensions typically on upper wiring levels.

The conductor signal paths 12*a*, and 12*b*, are arranged in parallel and spaced apart from one another by respective grounded capacitance lines 16, 18*a*, and 18*b*. In embodiments, the grounded capacitance lines 16, 18*a*, and 18*b*, are orthogonal to the conductor signal paths 12*a*, and 12*b*, and are separated by the capacitance shields or stubs 26, between the each of the conductor signal paths on each level.

Those of skill in the art should recognize that the overall inductance of the structure does not change significantly with the number of levels of conductor signal paths. That is, inductance will be the same for one, two, etc. levels of conductor signal paths. This being the case, the inductance of the different embodiments of the invention will remain the same or substantially the same, regardless of the number of conductor signal path layers. Also, advantageously, the capacitance of the structure will increase proportionately with the number of the layers used for the conductor signal paths. For example, the structure shown in FIG. 5 would have twice the capacitance as the structure of FIG. 1*a*. Accordingly, it is advantageous to have the conductor signal paths packed as densely as possible in order to increase the capacitance of the structure, and hence provide an increased signal delay (e.g., slow the signal propagation through the structure).

The structures described above can be fabricated using conventional lithographic and etching processes. For example, the metal layers can be deposited using any conventional metal deposition processes, after performing lithographic and etching processes in dielectric or insulator layers. Specifically, the forming of the lower grounded capacitance line, the plurality of conductor signal paths and the upper grounded capacitance line includes exposing a resist to form one or more openings, etching the insulator material to form trenches and depositing metal within the trenches. The metal lines of a conventional structure can be formed using conventional processes such that further explanation is not required herein.

Figure 6:
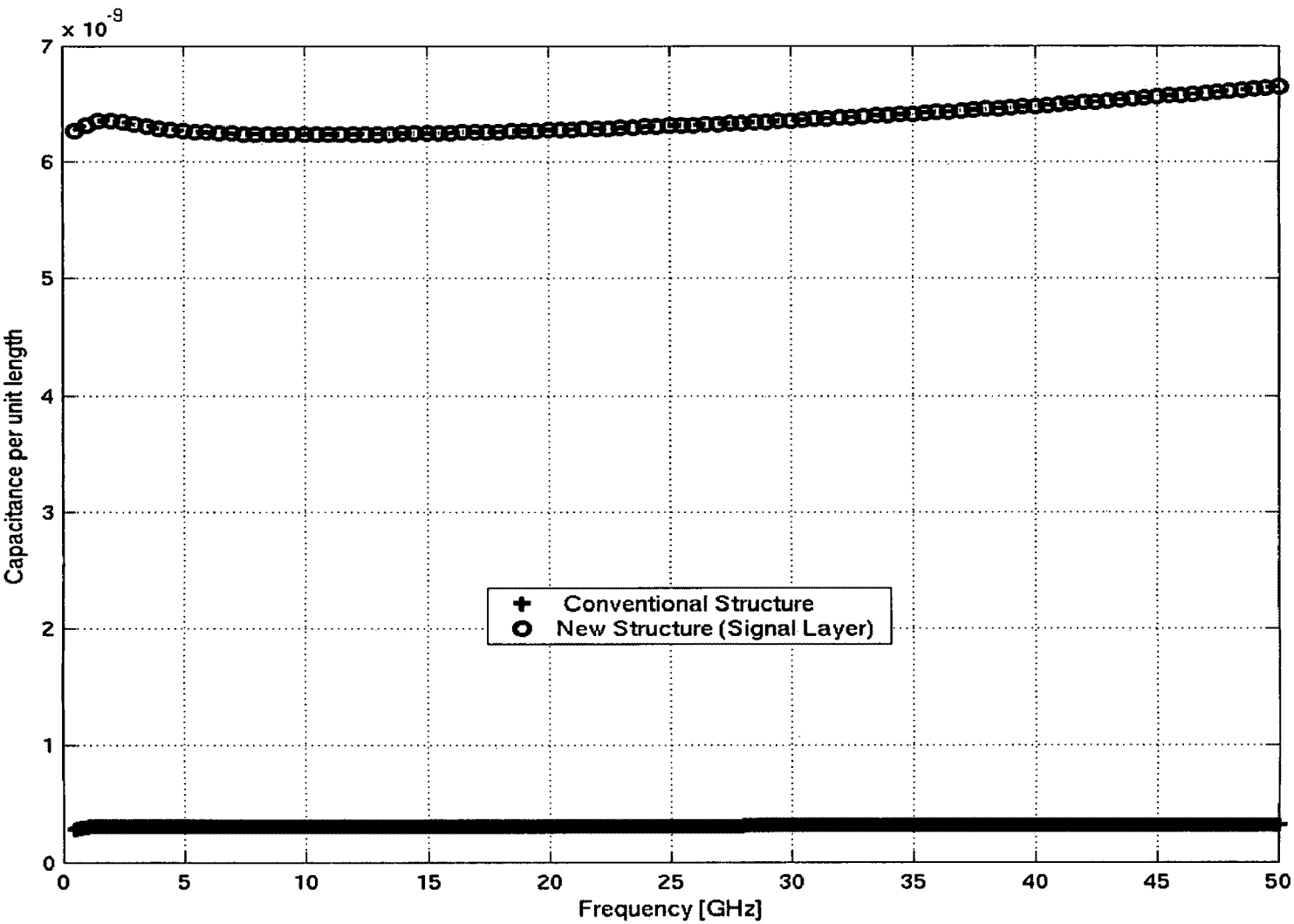
FIG. 6 shows a capacitance graph comparing a conventional structure with a single multi-conductor signal path in accordance with aspects of the invention.

FIG. 6 shows a capacitance graph comparing a conventional slow-wave structure with a single multi-layer multi-conductor signal path slow-wave structure in accordance with aspects of the invention. As shown in this graph, the single-layer multi-conductor slow-wave signal path of FIG. 1*a*, for example, shows a factor of approximately 21 improvement of capacitance per unit length compared to a conventional slow-wave structure having a single top signal layer with an about 18, micron width and 4, micron thickness.

Figure 7:
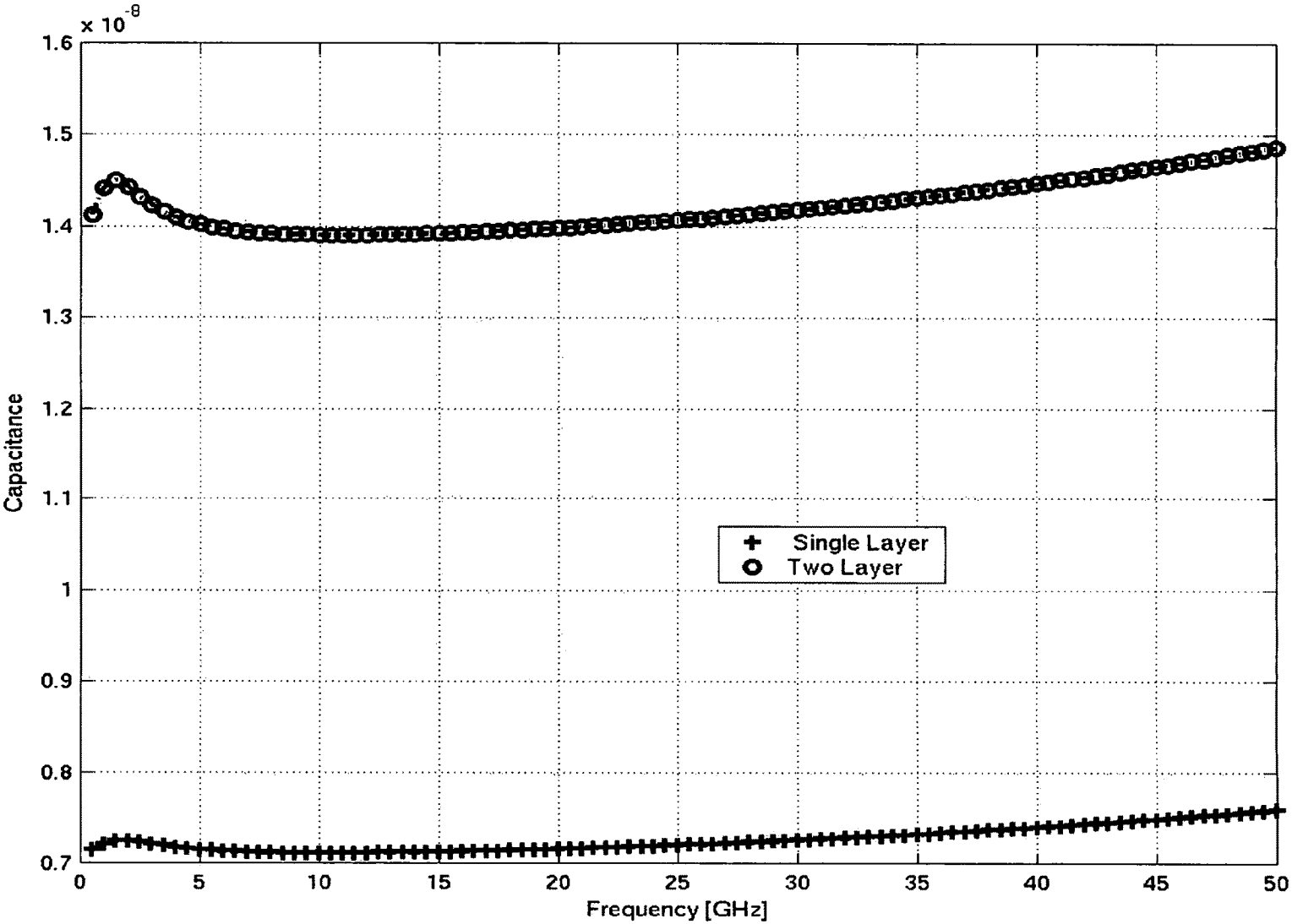
FIG. 7 shows a capacitance graph comparing a single and multi-layer multi-conductor signal path in accordance with aspects of the invention.

FIG. 7 shows a capacitance graph comparing a single and a multi-layer multi-conductor signal path slow-wave structure in accordance with aspects of the invention. As shown in this graph, the multi-layer multi-conductor slow-wave signal path structure of FIG. 5 shows a factor of approximately two (2) increase in capacitance per unit length compared to a single-layer slow-wave structure shown, for example, in FIG. 1*a*. The increase in capacitance will be proportional for three or more levels of conductor signal paths with the same thickness.

Figure 8:
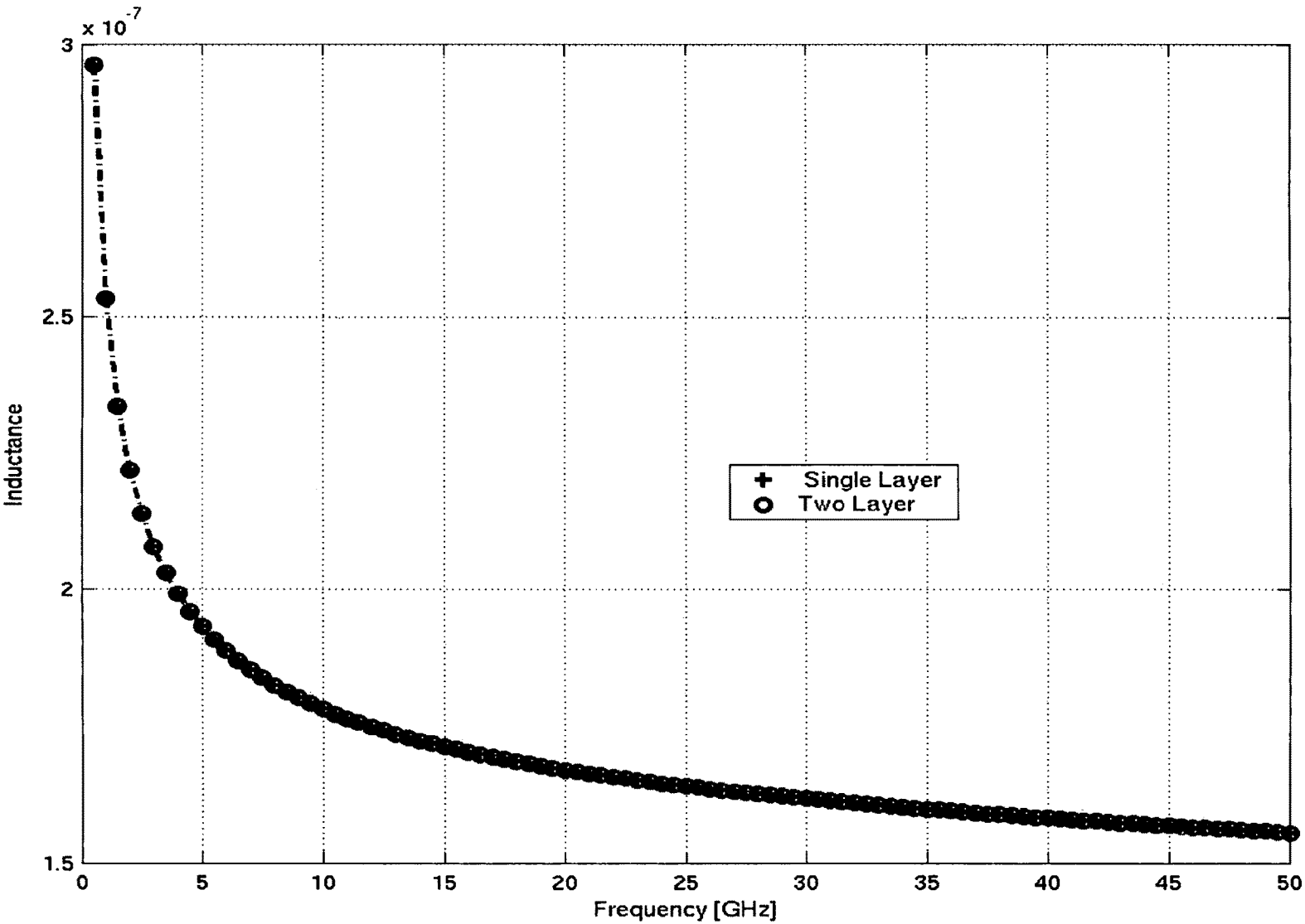
FIG. 8 shows an inductance graph comparing a single and multi-layer multi-conductor signal path in accordance with aspects of the invention.

FIG. 8 shows an inductance graph comparing a single and a multi-layer multi-conductor signal path slow-wave structure in accordance with aspects of the invention. As shown in this graph, the multi-layer multi-conductor slow-wave signal path structure of FIG. 5 shows the same inductance per unit length as the single-layer slow-wave structure shown, for example, in FIG. 1*a*.

Thus, as described above, the number of layers of conductor signal paths does not significantly affect the inductance of the slow-wave structure, but the capacitance will increase significantly. As such, the structures of the present invention are much slower than conventional slow-wave structures because they have much higher capacitance per unit length. Also, using multiple wiring layers of multi-conductors further decreases resistance, as resistance is inversely proportional to the number of conductors. That is, by splitting the signal into many smaller signal lines, the multiple thin metal lines (conductor signal paths) can be used instead of a conventional single thick metal line, thus dramatically increasing capacitance per unit length.

Design Structure

Figure 9:
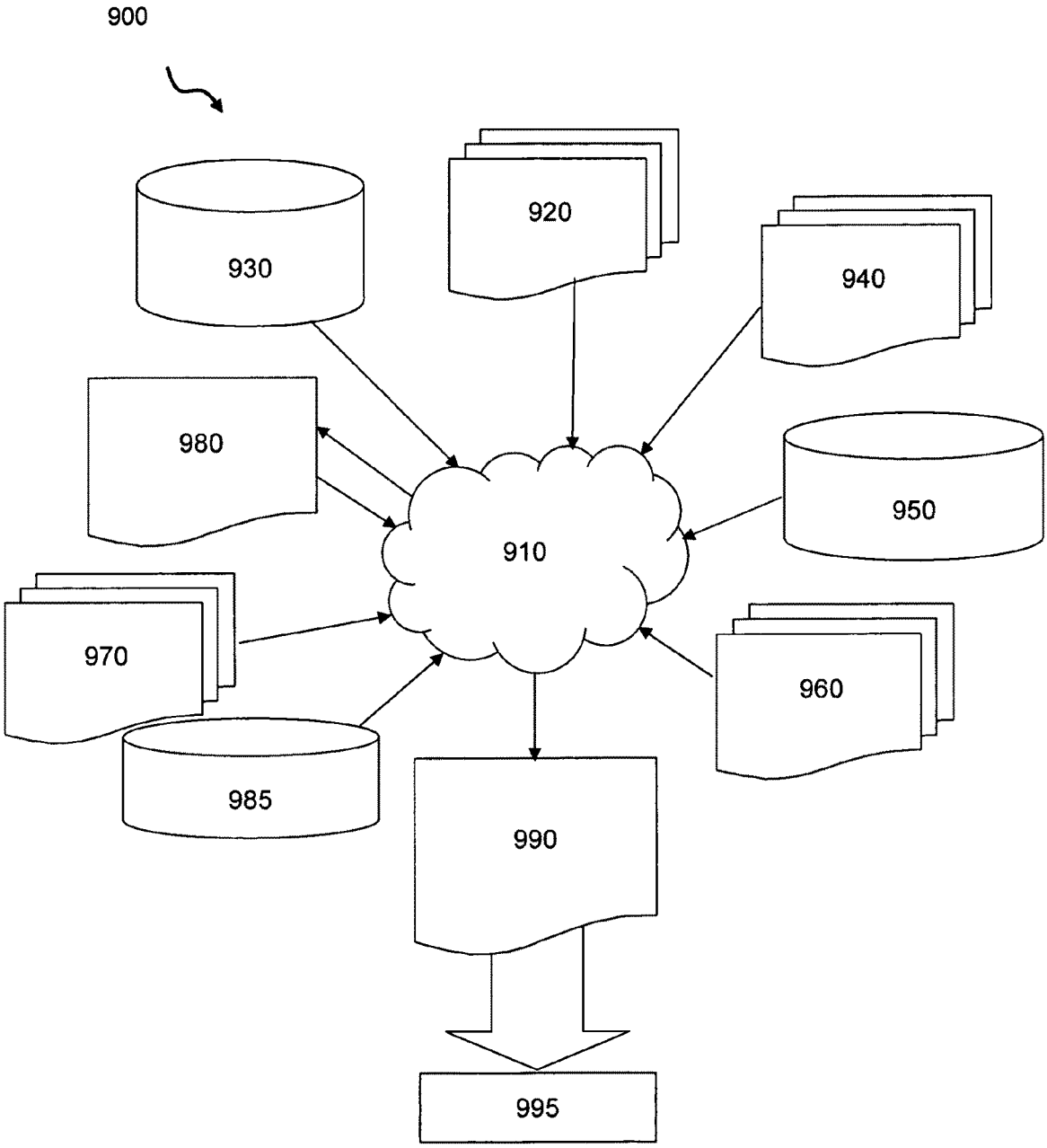
FIG. 9 is a flow diagram of a design process used in semiconductor design, manufacture, and/or test.

FIG. 9 illustrates multiple such design structures including an input design structure 920 that is preferably processed by a design process 910. Design structure 920 may be a logical simulation design structure generated and processed by design process 910 to produce a logically equivalent functional representation of a hardware device. Design structure 920 may also or alternatively comprise data and/or program instructions that when processed by design process 910, generate a functional representation of the physical structure of a hardware device. Whether representing functional and/or structural design features, design structure 920 may be generated using electronic computer-aided design (ECAD) such as implemented by a core developer/designer. When encoded on a machine-readable data transmission, gate array, or storage medium, design structure 920 may be accessed and processed by one or more hardware and/or software modules within design process 910 to simulate or otherwise functionally represent an electronic component, circuit, electronic or logic module, apparatus, device, or system such as those shown in FIGS. 1-5. As such, design structure 920 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 910 preferably employs and incorporates hardware and/or software modules for synthesizing, translating, or otherwise processing a design/simulation functional equivalent of the components, circuits, devices, or logic structures shown in FIGS. 1-5 to generate a netlist 980 which may contain design structures such as design structure 920. Netlist 980 may comprise, for example, compiled or otherwise processed data structures representing a list of wires, discrete components, logic gates, control circuits, I/O devices, models, etc. that describes the connections to other elements and circuits in an integrated circuit design. Netlist 980 may be synthesized using an iterative process in which netlist 980 is resynthesized one or more times depending on design specifications and parameters for the device. As with other design structure types described herein, netlist 980 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 910 may include hardware and software modules for processing a variety of input data structure types including netlist 980. Such data structure types may reside, for example, within library elements 930 and include a set of commonly used elements, circuits, and devices, including models, layouts, and symbolic representations, for a given manufacturing technology (e.g., different technology nodes, 32, nm, 45, nm, 90 nm, etc.). The data structure types may further include design specifications 940, characterization data 950, verification data 960, design rules 970, and test data files 985 which may include input test patterns, output test results, and other testing information. Design process 910 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 910 without deviating from the scope and spirit of the invention. Design process 910 may also include modules for performing standard circuit design processes such as timing analysis, verification, design rule checking, place and route operations, etc.

Design process 910 employs and incorporates logic and physical design tools such as HDL compilers and simulation model build tools to process design structure 920 together with some or all of the depicted supporting data structures along with any additional mechanical design or data (if applicable), to generate a second design structure 990. Design structure 990 resides on a storage medium or programmable gate array in a data format used for the exchange of data of mechanical devices and structures (e.g. information stored in a IGES, DXF, Parasolid XT, JT, DRG, or any other suitable format for storing or rendering such mechanical design structures). Similar to design structure 920, design structure 990 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 1-5. In one embodiment, design structure 990 may comprise a compiled, executable HDL simulation model that functionally simulates the devices shown in FIGS. 1-5.

Design structure 990 may also employ a data format used for the exchange of layout data of integrated circuits and/or symbolic data format (e.g. information stored in a GDSII (GDS2), GL1, OASIS, map files, or any other suitable format for storing such design data structures). Design structure 990 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1-5. Design structure 990 may then proceed to a stage 995 where, for example, design structure 990: proceeds to tape-out, is released to manufacturing, is released to a mask house, is sent to another design house, is sent back to the customer, etc.

The methods and/or design structure as described above is used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements, if any, in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

What is claimed is:

1. A slow wave structure, comprising:

a plurality of conductor signal paths arranged in a substantial parallel arrangement;

a first grounded capacitance line or lines positioned below the plurality of conductor signal paths and arranged substantially orthogonal to the plurality of conductor signal paths;

a second grounded capacitance line or lines positioned above the plurality of conductor signal paths and arranged substantially orthogonal to the plurality of conductor signal paths;

a grounded plane, grounding the first and second grounded capacitance line or lines; and a plurality of capacitance shields each arranged between each of the plurality of conductor signal paths and connected to each of the first and second grounded capacitance line or lines at plural locations by a plurality of via structures, respectively.

2. The slow wave structure of claim 1, wherein the first and second grounded capacitance line or lines are each a single line arranged in a serpentine shape.

3. The slow wave structure of claim 1, wherein the capacitance shields have a thickness ranging from about 0.05 micron to about 4 microns with a width ranging from about 0.05 microns to about 10 microns.

4. The slow wave structure of claim 1, wherein a spacing between the capacitance shields and the plurality of conductor signal paths is about 0.05 microns to about 4 microns.

5. The slow wave structure of claim 1, wherein a spacing between the plurality of conductor signal paths and each of the first and second grounded capacitance line or lines is about 0.4 microns.

6. The slow wave structure of claim 1, wherein the plurality of conductor signal paths are arranged on a lower metal layer level.

7. The slow wave structure of claim 1, wherein the plurality of conductor signal paths range from about 0.05 micron to about 4 microns in thickness.

8. The slow wave structure of claim 1, wherein the plurality of conductor signal paths have a thickness ranging from about 0.1 micron to about 4 microns.

9. The slow wave structure of claim 1, further comprising a second plurality of conductor signal paths arranged in a substantial parallel arrangement arranged above the second grounded capacitance line or lines and below a third grounded capacitance line or lines, the second and third grounded capacitance lines or lines being arranged substantially orthogonal to the plurality of conductor signal paths.

10. The slow wave structure of claim 1, wherein the first grounded capacitance line or lines and the second grounded capacitance line or lines are arranged in a substantial parallel arrangement.

11. The slow wave structure of claim 1, wherein the plurality of conductor signal paths, the first grounded capacitance line or lines and the second grounded capacitance line or lines are embedded in an insulator material.

12. A slow wave structure, comprising:

a ground plate;

a first grounded capacitance line having segments arranged in a substantial parallel arrangement, the first ground capacitance line being grounded to the ground plate;

a second grounded capacitance line having segments arranged in a substantial parallel arrangement, the second ground capacitance line being grounded to the ground plate;

a plurality of conductor signal paths arranged between the first grounded capacitance line and the second grounded capacitance line, the plurality of conductor signal paths being arranged in a parallel arrangement and orthogonal to the first grounded capacitance line and the second first grounded capacitance; and a plurality of capacitance shields arranged between each of the plurality of conductor signal paths and connected to the first grounded capacitance line and the second grounded capacitance line at corresponding positions by a plurality via structures, respectively.

13. The slow wave structure of claim 12, wherein a spacing between the capacitance shields and the plurality of conductor signal paths is about 0.05 microns to about 4 microns.

14. The slow wave structure of claim 12, wherein a spacing between the plurality of conductor signal paths and each of the first and second grounded capacitance line is about 0.4 microns.

15. The slow wave structure of claim 12, further comprising a second plurality of conductor signal paths arranged in a substantial parallel arrangement above the second grounded capacitance line and below a third grounded capacitance line, the second and third grounded capacitance lines being arranged substantially orthogonal to the plurality of conductor signal paths.

16. The slow wave structure of claim 12, wherein the first grounded capacitance line and the second grounded capacitance line are arranged in a substantial parallel arrangement.

17. The slow wave structure of claim 1, wherein the plurality of conductor signal paths, the first grounded capacitance line or lines and the second grounded capacitance line or lines are embedded in an insulator material.

18. A method of manufacturing a slow wave structure, comprising:

forming a lower grounded capacitance line in an insulator material, above or below a grounded plane;

forming a plurality of conductor signal paths in a substantial parallel arrangement in the insulator material and above the lower grounded capacitance line, the plurality of conductor signal paths being formed substantially orthogonal to the upper grounded capacitance line;

forming an upper grounded capacitance line in the insulator material above the plurality of conductor signal paths, the upper grounded capacitance line being formed substantially orthogonal to the plurality of conductor signal paths; and forming a plurality of capacitance shields in the insulator material such that each capacitance shield is arranged between each of the plurality of conductor signal paths and connected to each of the upper and lower grounded capacitance lines at plural locations by a plurality of via structures, respectively.

19. The method of claim 18, wherein the forming of the lower grounded capacitance line, the plurality of conductor signal paths and the upper grounded capacitance includes exposing a resist to form one or more openings, etching the insulator material to form trenches and depositing metal within the trenches.

20. The method of claim 18, further comprising:

forming a second plurality of conductor signal paths in a substantial parallel arrangement in the insulator material and above the upper grounded capacitance line, the plurality of conductor signal paths being formed substantially orthogonal to the upper grounded capacitance line; and forming a higher grounded capacitance line in the insulator material above the second plurality of conductor signal paths, the higher grounded capacitance line being formed substantially orthogonal to the plurality of conductor signal paths.

21. A method in a computer-aided design system for generating a functional design model of an on-chip slow wave transmission line structure, said method comprising the steps of:

generating, Using the computer-aided design system, a functional representation of:

a plurality of conductor signal paths arranged in a substantial parallel arrangement;

a first grounded capacitance line or lines positioned below the plurality of conductor signal paths and arranged substantially orthogonal to the plurality of conductor signal paths;

a second grounded capacitance line or lines positioned above the plurality of conductor signal paths and arranged substantially orthogonal to the plurality of conductor signal paths a grounded plane, grounding the first and second grounded capacitance line or lines; and a plurality of capacitance shields each arranged between each of the plurality of conductor signal paths and connected to each of the first and second grounded capacitance line or lines at plural locations by a plurality of via structures, respectively.

22. The method of claim 21, wherein the functional design model comprises a netlist.

23. The method of claim 21, wherein the functional design model resides on storage medium as a data format used for an exchange of layout data of integrated circuits.

24. The method of claim 21, wherein the functional design model resides in a programmable gate array.

25. The slow wave structure of claim 1, wherein the plurality of capacitance shields are positioned substantially close to the plurality of conductor signal paths and are physically spaced apart from the first and second grounded capacitance line or lines by the plurality of via structures.

* * * * *